US010780480B1

(12) United States Patent
Stuckey

(10) Patent No.: US 10,780,480 B1
(45) Date of Patent: Sep. 22, 2020

(54) SHEET METAL STRAIGHTENING DEVICE

(71) Applicant: Carl Albert Stuckey, Hilton Head Island, SC (US)

(72) Inventor: Carl Albert Stuckey, Hilton Head Island, SC (US)

( * ) Notice: Subject to any disclaimer, the term of this patent is extended or adjusted under 35 U.S.C. 154(b) by 0 days.

(21) Appl. No.: 16/692,482

(22) Filed: Nov. 22, 2019

(51) Int. Cl.
*B21D 1/06* (2006.01)
*B25B 5/02* (2006.01)

(52) U.S. Cl.
CPC . *B21D 1/06* (2013.01); *B25B 5/02* (2013.01)

(58) Field of Classification Search
CPC .. B21D 1/06; B21D 1/14; B21D 1/145; B25B 5/02; B25B 5/068; B25B 5/12; B25B 5/127; B25B 33/00; B25B 5/166; B25B 5/16; B25B 7/02; B25B 7/12
See application file for complete search history.

(56) References Cited

U.S. PATENT DOCUMENTS 3,425,098 A * 2/1969 Martin ..... B25B 5/12 24/68 R
2019/0076993 A1* 3/2019 Buchanan ..... B25G 1/005
2019/0351532 A1* 11/2019 Lai ..... B25B 7/02

OTHER PUBLICATIONS

Amazon, Grip-On 7" Axial Grip L-Shaped Locking Pliers—Epoxy Coated GR91207; published at least as early as Jul. 9, 2019; https://www.amazon.com/Grip-Axial-L-Shaped-Locking-Pliers/dp/B000SOU5V2?th=1, Amazon, Inc.; United States.

* cited by examiner

*Primary Examiner* — Debra M Sullivan
(74) *Attorney, Agent, or Firm* — Stephen C. Thomas

(57) ABSTRACT

A hole straightening apparatus for removing surface deformities in a desired surface shape. A frame is pivotally attached to a handle. The handle is pivotally attached to a moving jaw that is slidingly engaged with the frame. When the handle is motivated towards the frame, a moving jaw is caused to slide along a surface of the frame towards a stationary anvil. Sheet metal to be straightened is captured between an anvil surface of the moving jaw and an anvil surface of the stationary anvil, causing a compressive force between the two anvil surfaces. Sequential operation of the handle causes sequential compressive forces to be applied to the deformed sheet metal structure as the stationary anvil is rotated around the edge of the hole. As a result, the deformed edges of the hole in the sheet-metal structure are substantially straightened.

12 Claims, 9 Drawing Sheets

SHEET METAL STRAIGHTENING DEVICE

CROSS REFERENCE TO RELATED APPLICATIONS AND INCORPORATION BY REFERENCE

[Not applicable]

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISK

Not applicable.

BACKGROUND OF THE INVENTION

1. Field of the Invention

The field of the invention relates generally to systems and methods for repairing deformed structures such as automobile bodies and body parts. More specifically, in embodiments, the invention relates to systems and methods for producing a desired surface in a vehicle body or body part in or near a location on the structure in which a hole is located during the course of repair of a body part, after the body part has been subjected to unwanted disfiguring forces that have resulted in undesired protuberances, creases, bends, and other disfigurements and deformities that cause the body part to have a surface shape and appearance that is not in conformity with a desired surface shape. The desired surface shape may be flat or curved along one or more cross sections. The body part may, but does not necessarily, comprise sheet metal structures.

2. Background Art

There are many scenarios in which it is desired to return a disfigured sheet structure to a desired surface shape. Such disfigured sheet structures may result, for example, in the case in which vehicle body parts have been subjected to disfiguring forces resulting from collisions between vehicles, or between a vehicle and another stationary or moving object. In some cases the disfiguring forces causing the unwanted disfigurement may result from other body or repair work that is being performed upon a vehicle. In another non-limiting case, the disfiguring forces may result from severe weather, such as may be caused by the impact of hail or falling ice on a sheet structure, leaving unwanted dents in the sheet structure that cause the sheet structure to have a surface shape and appearance that is not in conformity with a desired surface shape, which may be flat or cured along one or more cross sections. Non-limiting examples of sheet structures that have been disfigured and thus have a surface shape that is not in conformity with a desired planar shape due to hail damage are automobile bodies, motorcycle body parts, and metal roofs such as, for example, corrugated metal roof panels and the like. Often such structures contain holes, around which the sheet structure has been deformed. Such deformities may occur during vehicle body work when panels are detached from a vehicle. In many cases, it is required that such deformities be substantially removed from surfaces that are not feasible to place in a floor machine press due to the shape of the part, or the construction of the part, or for other reasons.

What is needed in the art, therefore, is an apparatus and/or method adapted to quickly and efficiently straightening of deformities surrounding a hole in a sheet metal surface for which it not feasible to use a floor machine press, substantially and quickly returning the sheet metal surface to a desired surface shape.

BRIEF SUMMARY OF THE INVENTION

The present invention comprises an apparatus and method that have one or more of the following features and/or steps, which alone or in any combination may comprise patentable subject matter.

In accordance with one embodiment of the present invention, the invention comprises a hole straightening apparatus, comprising: a handle pivotally attached to a frame; a moving jaw comprising an anvil surface, wherein the moving jaw is slidingly engaged with a surface of the frame; a stationary jaw comprising an anvil surface wherein the stationary jaw is attached to the frame; and a lever pivotally attached to the frame and pivotally attached to the handle; wherein when the handle is motivated towards the frame, a surface of the lever is in contact with and motivates the moving jaw along a surface of the frame towards the stationary jaw; the hole straightening apparatus having a closed state wherein the anvil surface of the moving jaw is in contact with, and exerts a compressive force against, the anvil surface of the stationary jaw; and the hole straightening apparatus having an open state wherein the anvil surface of the moving jaw is motivated away from the anvil surface of the stationary jaw, creating an anvil gap between the he anvil surface of the moving jaw and the anvil surface of the stationary jaw; and wherein the stationary anvil has a width less than a dimension of a hole in a sheet metal structure desired to be straightened.

In embodiments, the moving anvil may have a width less than a dimension of a hole in a sheet metal structure desired to be straightened.

In embodiments the stationary jaw may be fabricated from sheet steel.

In embodiments, the stationary jaw may be interchangeable with other stationary jaws of differing dimension to accommodate a variety of dimensioned or shaped holes in a sheet structure to be straightened. In embodiments, the stationary jaw may be releasably attached to the frame.

In embodiments the moving jaw may be fabricated from sheet steel.

In embodiments the invention may comprise a threaded compression force adjusting rod threadingly engaged with the frame and protruding into the frame, wherein a distal surface of the threaded compression force adjusting rod is in contact with a surface of a lever pivotally attached to the handle such that when the threaded compression force adjusting rod is rotated so as to protrude further into the frame, the compressive force is increased when the hole straightening apparatus is in a closed state, and when the distal surface of the threaded compression force adjusting rod is rotated so as to proceed further out of the frame, the compressive force is decreased when the hole straightening apparatus is in a closed state.

The present method and device of the invention overcome the shortcomings of the prior art by providing a handheld tool for quick and efficient straightening of deformities surrounding a hole in a sheet metal surface, substantially and quickly returning the sheet metal surface to a desired surface shape.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating the preferred embodiments of the invention and are not to be construed as limiting the invention. In the drawings.

Figure 1:
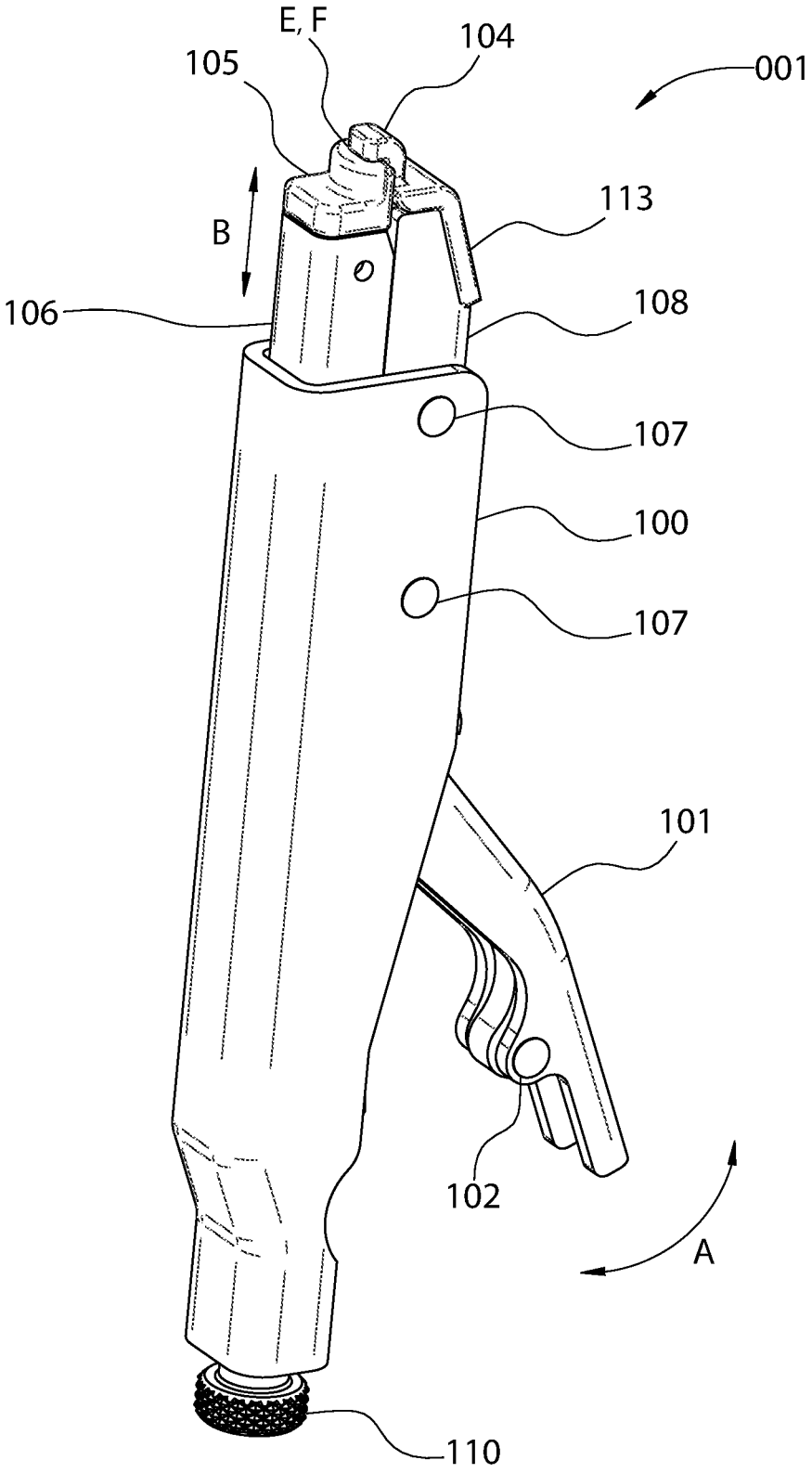
FIG. 1 depicts a perspective view of a non-limiting exemplary embodiment of a sheet metal straightener of the invention in a closed state, in which the moving anvil has been fully motivated against the stationary anvil of the invention.

In the figures, like callout numbers refer to like features.

DETAILED DESCRIPTION OF THE INVENTION

The following documentation provides a detailed description of the invention.

Although a detailed description as provided in the attachments contains many specifics for the purposes of illustration, anyone of ordinary skill in the art will appreciate that many variations and alterations to the following details are within the scope of the invention. Accordingly, the following preferred embodiments of the invention are set forth without any loss of generality to, and without imposing limitations upon, the claimed invention. Thus the scope of the invention should be determined by the appended claims and their legal equivalents, and not merely by the preferred examples or embodiments given.

As used herein, "disfiguring forces" includes within its meaning one or more forces that, when acting upon a sheet structure, cause the structure to be deformed such that a surface of the sheet structure no longer conforms to a desired surface shape.

As used herein, "desired surface shape" includes within its meaning any desired surface shape. A non-limiting example of a desired surface shape is a plane, which plane may be flat or may be a curved plane. As another non-limiting example, the desired surface shape may be that of a curved plane that is characterized by one or more curvilinear cross sections of the sheet structure. The desired surface shape may be any surface shape desired by a user.

As used herein, "hole to be straightened" and "sheet metal structure to be straightened" refer to a sheet metal surface having undesired deformities that depart from a desired surface shape, for which the removal of the deformities such that the sheet metal structure is substantially returned to a desired surface shape ("straightening") is desired. Such undesired deformities may be the result of the prior application of disfiguring forces to a sheet structure.

As used herein, "closed state" means that state in which moving jaw 106 and moving anvil 105 have been motivated in the direction of arrow B, as depicted in the figures, towards stationary anvil 113 such that an anvil surface of moving anvil 105 is in contact with and is pressed against an anvil surface of stationary anvil 113 with a closing force F. The compressive force F pressing moving anvil 105 into stationary anvil 113 is also the force that is applied to the upper and lower surfaces of a deformed sheet metal structure for which it is desired to straighten the edges of a hole disposed in the sheet metal structure.

As used herein, "open state" means that state in which moving jaw 106 and moving anvil 105 have been motivated in the direction of arrow B, as depicted in the figures, away from a stationary anvil 113 such that an anvil surface of moving anvil 105 is no longer in contact with, and is motivated away from, the anvil surface of stationary anvil 113. In the open state, there is no force asserted between the anvil surfaces of stationary anvil 113 and moving anvil 105. When the hole straightener of the invention is disposed in an open state, it is possible to motivate stationary anvil 104 through a hole to be straightened and to translate stationary anvil 104 along the sheet-metal surfaces surrounding the hole to be straightened, sequentially straightening the sheet metal surrounding the hole, until the sheet metal surrounding the hole has been substantially returned to a desired surface shape.

Figure 3:
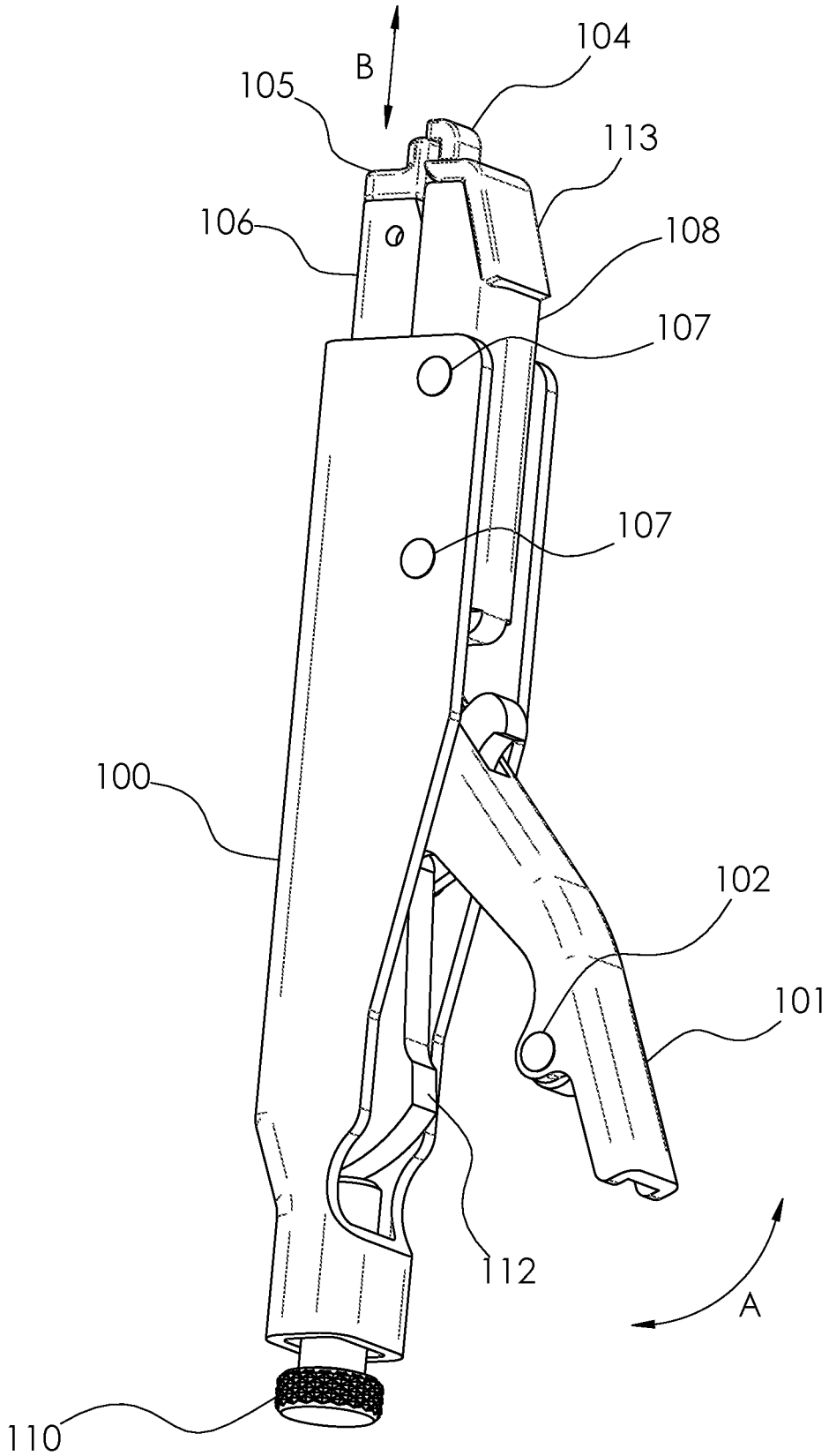
FIG. 3 depicts a perspective view of a non-limiting exemplary embodiment of a sheet metal straightener of the invention in a closed state, in which the moving anvil has been fully motivated against the stationary anvil of the invention of the invention.

Referring now to FIGS. 1 and 3, views of the sheet metal straightening apparatus of the invention 001 are depicted in which the invention is disposed in a closed state in which moving jaw 106 and moving anvil 105 have been motivated fully into a closed state. FIG. 1 depicts an embodiment of the hole straightening apparatus of the invention from a side perspective view. FIG. 3 depicts an embodiment of the hole straightening apparatus of the invention from a rear perspective view. In the closed state as depicted in FIGS. 1 and 3, handle 101 has been motivated in the direction of arrow A towards frame 100 about pivot point 120 (depicted in FIG. 5). Pivot point 120 may comprise a cylindrical pin, axle, screw, shoulders screw or other substantially cylindrical element that allows the rotation of pivot handle 100 about moving jaw 106 at pivot point 120. The operation of the hole straightening apparatus in transitioning from an open state to a closed state, and vice versa, is more fully described below in relation to FIG. 5. Stationary jaw 108 may be attached to frame 100 by mechanical attachments 107. Mechanical attachments 107 may take any form known in the art such as threaded fasteners, press pins, rivets, or any other means for attaching one mechanical component to another. In embodiments, mechanical attachments 107 may easily removable with or without tools, such as, by way of example and not by way of limitation, threaded fasteners, pins having retaining features such as Cotter pins, spring loaded ball detent arrangements, or the like, in order to allow stationary jaw 108 to be removably attached to frame 100. Such removable attachment of stationary jaw 108 to frame 100 enables the stationary jaw 108 and stationary anvil 104 to be removed and replaced by other embodiments of stationary jaw 108 and stationary anvil 104 in which stationary anvil 104 width W (not shown in FIG. 1, but shown in FIG. 7) is adapted to pass through openings Y of varying width forming a part of hole 201 in a sheet metal structure to be straightened 200 (not depicted in FIG. 1 but depicted in FIGS. 11 and 12). In this manner stationary jaw 108 and stationary anvil 104 may be fabricated in any number of interchangeable embodiments in order to adapt the invention to various size holes 201 or to adapt the invention to various configurations of sheet metal structures to be straightened. In embodiments, mechanical attachments 107 may take the form of permanent attachments such as weldments, chemical bonding or any other means of attachment. Stationary jaw 108 may be attached to a stationary anvil bracket 113 to which stationary anvil 104 is attached. Stationary anvil bracket 113 and stationary anvil 104 may, but do not necessarily, form a unitary structure. In embodiments, stationary anvil bracket 113 and stationary anvil 104 may be formed from a single portion of sheet material. Moving anvil surface F and stationary anvil surface E are depicted for reference. Pivot points 111 and 102 are depicted for reference.

Figure 2:
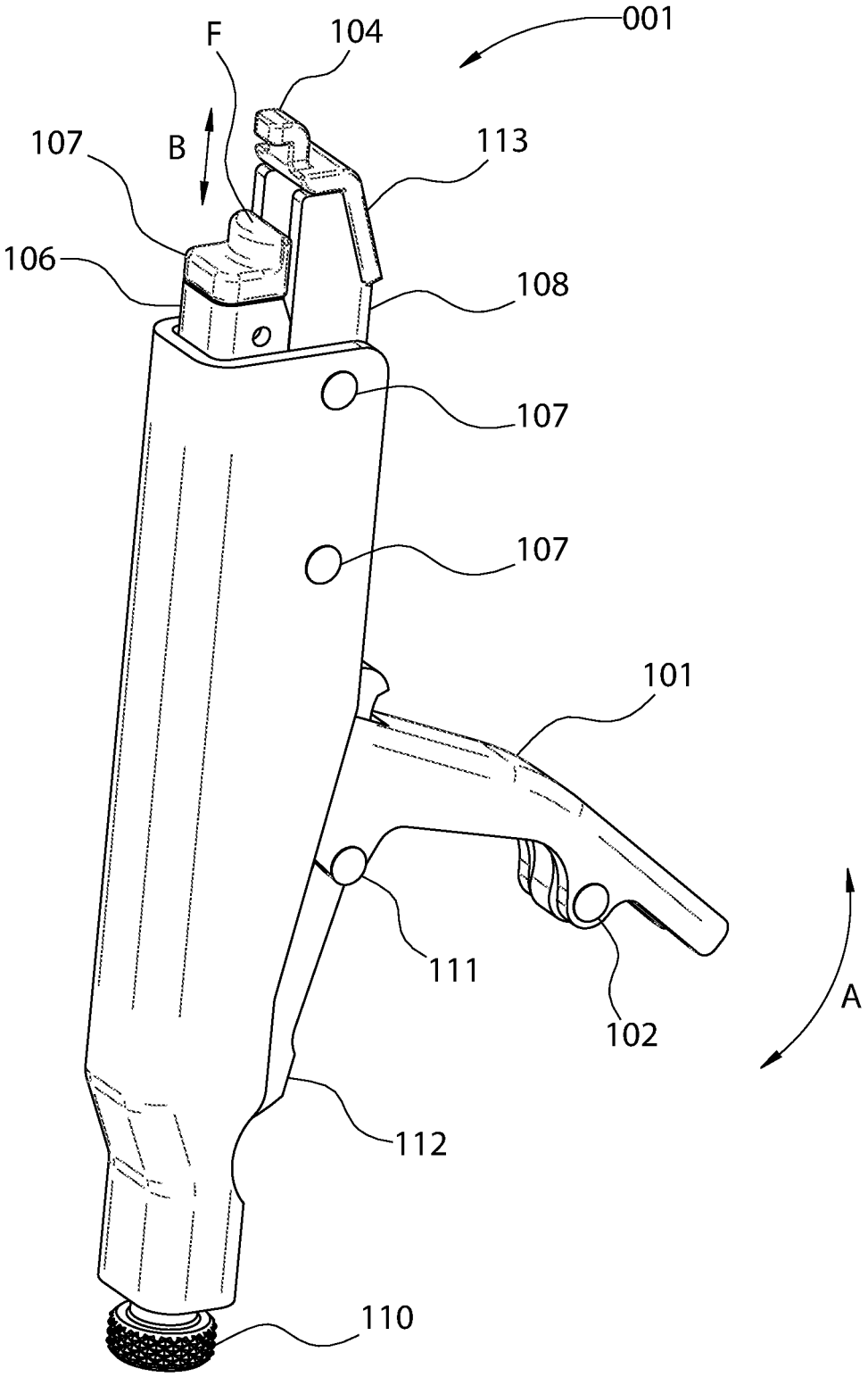
FIG. 2 depicts a perspective view of a non-limiting exemplary embodiment of a sheet metal straightener of the invention in an open state, in which the moving anvil has been motivated away from the stationary anvil of the invention.
Figure 4:
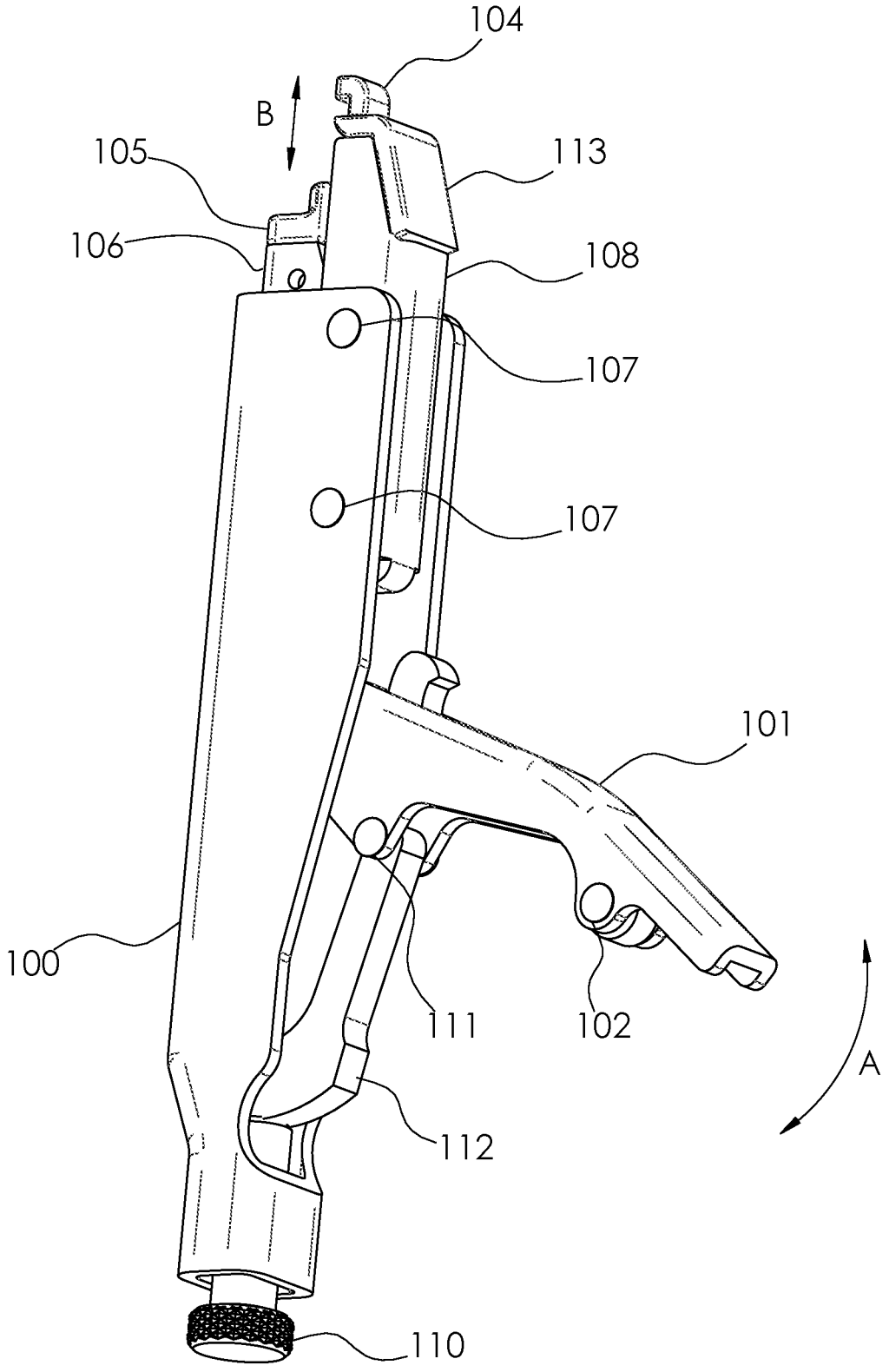
FIG. 4 depicts a perspective view of a non-limiting exemplary embodiment of a sheet metal straightener of the invention in an open state, in which the moving anvil has been fully motivated against the stationary anvil of the invention of the invention.

Referring now to FIGS. 2 and 4, views of the sheet metal straightening apparatus of the invention 001 are depicted in which the invention is disposed in an open state in which moving jaw 106 and moving anvil 105 have been motivated fully into an open state, i.e., in a direction away from stationary anvil 104. FIG. 2 depicts an embodiment of the hole straightening apparatus of the invention from a side perspective view. FIG. 4 depicts an embodiment of the hole straightening apparatus of the invention from a rear perspective view. In the open state as depicted in FIGS. 2 and 4, handle 101 has been motivated in the direction of arrow A away from frame 100 about pivot point 120 (depicted in FIG. 5). Pivot point 120 may comprise a cylindrical pin, axle, screw, shoulder screw or other mechanical element, which may be, but is not necessarily, cylindrical, that allows the rotation of pivot handle 100 about moving jaw 106 at pivot point 120. The operation of the hole straightening apparatus 001 in transitioning from a closed state to an open state, and vice versa, is more fully described below in relation to FIG. 5. Stationary jaw 108 may be attached to frame 100 by mechanical attachments 107. Mechanical attachments 107 may take any form known in the art such as threaded fasteners, press pins, rivets, or any other means for attaching one mechanical component to another. In embodiments, mechanical attachments 107 may take the form of permanent attachments such as weldments, chemical bonding or any other means of attachment. Stationary jaw 108 may be attached to stationary anvil bracket 113 to which stationary anvil 104 is attached. Stationary anvil bracket 113 and stationary anvil 104 may, but do not necessarily, form a unitary structure. In embodiments, stationary anvil bracket 113 and stationary anvil 104 may be formed from a single portion of sheet material. Moving anvil surface F and stationary anvil surface E are depicted for reference. Pivot points 111 and 102 are depicted for reference.

Figure 5:
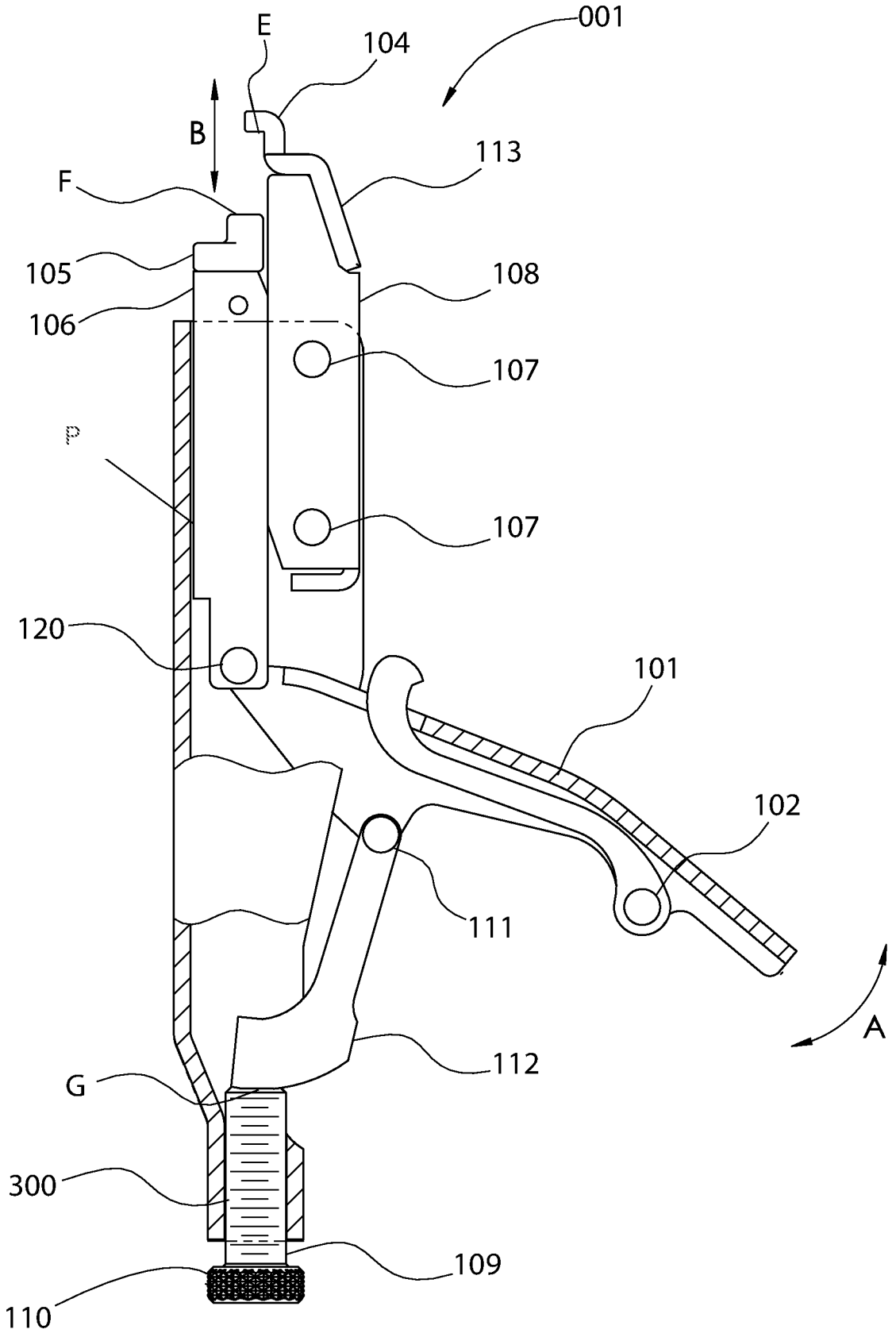
FIG. 5 depicts a partial cross section side view of a non-limiting exemplary embodiment of a sheet metal straightener of the invention in an open state, in which the moving anvil has been fully motivated away from the stationary anvil of the invention of the invention.
Figure 6:
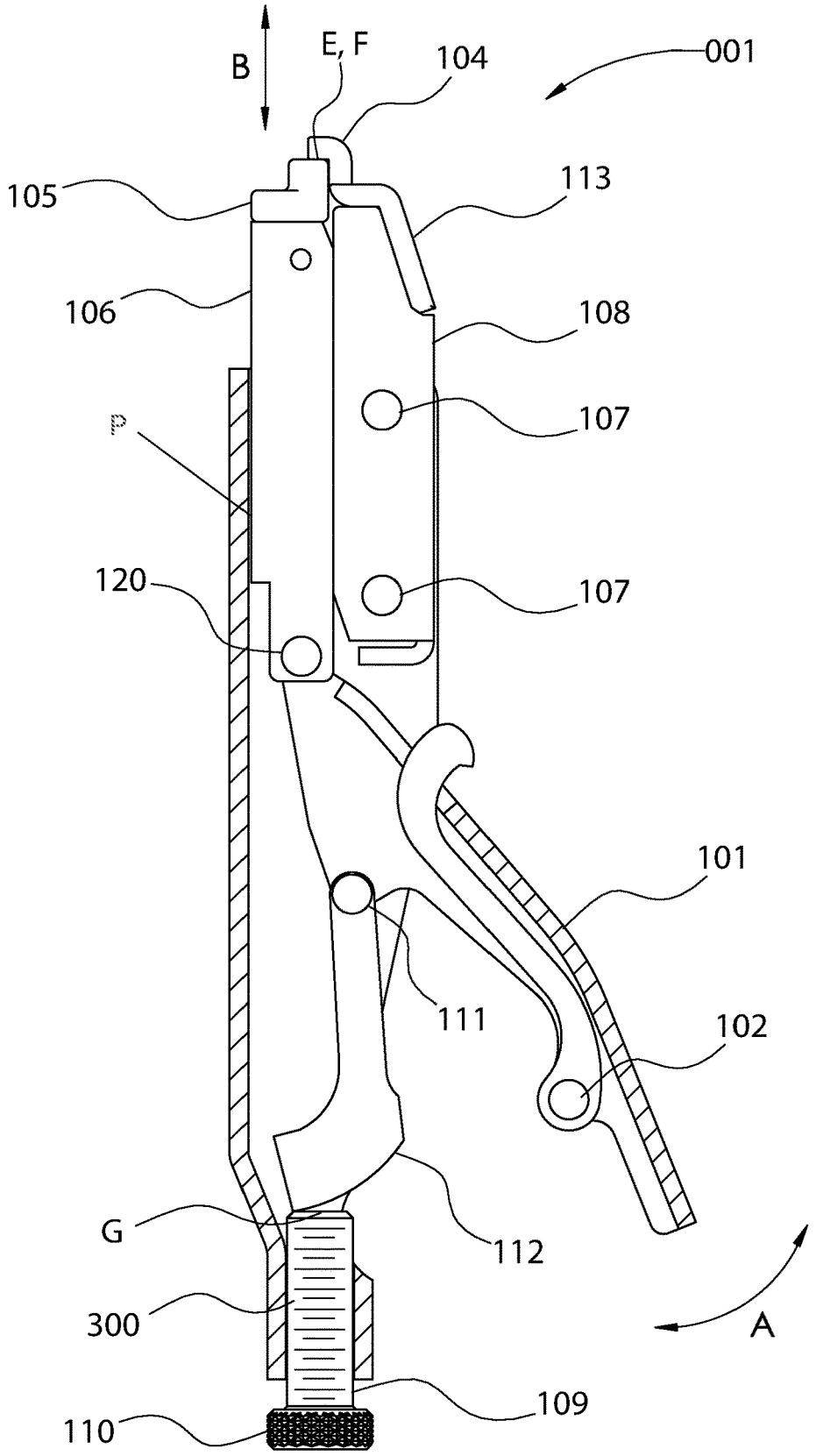
FIG. 6 depicts a partial cross section side view of a non-limiting exemplary embodiment of a sheet metal straightener of the invention in a closed state, in which the moving anvil has been fully motivated against the stationary anvil of the invention of the invention.

Referring now to FIGS. 5 and 6, a side view of a non-limiting exemplary embodiment of a sheet metal straightener of the invention 001 in an open state, in which the moving anvil 105 has been fully motivated away from the stationary anvil 104 of the invention of the invention, is depicted. In the open state, stationary anvil 104 may be motivated and articulated such that it is able to pass through a hole 201 in a deformed sheet metal structure 200 (see FIGS. 8 and 10) for which straightening is desired. Stationary anvil 104 may have a width W that is smaller than a dimension of the hole 201 located in the sheet metal structure 200 for which straightening is desired. Thus, stationary anvil 104 may be articulated such that it may be motivated through the hole in the sheet metal structure as depicted further in FIGS. 8 and 10. Stationary anvil 104, stationary anvil bracket 113, and stationary jaw 108 may be fabricated as separate components and assembled by any means known in the art such as welding, chemical bonding, riveting, threaded fastener's, or the like; or, alternatively, stationary anvil 104, stationary anvil bracket 113 and stationary jaw 108 may be a unitary structure fabricated by any means known in the art such as, for example and not by way of limitation, casting, molding, machining, additive manufacturing or any other means and method of manufacture. In an embodiment, stationary jaw 108 and stationary anvil 104 may each be fabricated from bent sheet-metal and welded or bonded together. Likewise, moving anvil 105 and moving jaw 106 may be a unitary structure fabricated by any means known in the art such as, for example and not by way of limitation, casting, molding, machining or any other means and method of manufacture. In an embodiment, moving jaw 106 may be fabricated from sheet metal. In an embodiment, moving anvil 105 may be fabricated by any means known in the art such as, for example and not by way of limitation, casting, molding, machining or any other means and method of manufacture. Stationary jaw 108 may be attached to frame 100 by attachments 107 as herein before described.

Handle 101 may be rotably attached to lever 112 at attachment point 111. When handle 101 is motivated towards frame 100 as shown by arrow A such that the hole straightening device of the invention 001 is transitioned to a closed state (see FIG. 6 for a depiction of the closed state), the pivoting action at pivot points 111 and 120 cause moving a jaw 106 to be motivated in the direction of arrow B towards stationary anvil 104 and stationary anvil surface E as moving jaw 106 slides along surface P of frame 100 in a sliding engagement. When handle 101 is motivated away from a frame 100 as shown by arrow A such that the sheet metal straightening of the device of the invention 001 is transitioned to an open state as shown in FIG. 5, and the pivoting actions at points 111 and 120 cause moving jaw 106 to be motivated in the direction of arrow B away from stationary anvil 104 and stationary anvil surface E as moving jaw 106 slides along surface C of frame 100 in a sliding engagement.

Still referring to FIGS. 5 and 6, the invention 100 may further comprise a threaded compression force adjusting rod 109 that may be threadingly engaged 300 with a portion of frame 100 and protruding into frame 100, wherein a distal surface G of the threaded compression force adjusting rod may be in contact with a surface of lever 112 that is pivotally attached to handle 101 at pivot point 111 such that when threaded compression force adjusting rod 109 is rotated so as to protrude further into frame 100, the compressive force between moving anvil surface F and stationary anvil surface E, or between moving anvil surface F, an intervening sheet structure to be straightened 200, and stationary anvil surface E, is increased to a desired level when the hole straightening apparatus is in a closed state, and when the threaded compression force adjusting rod 109 is rotated so that the distal surface G of compression force adjusting rod 109 proceeds further out of the frame, the compressive force between moving anvil surface F and stationary anvil surface E is decreased when the hole straightening apparatus is in a closed state. In FIG. 6, a side view of a non-limiting exemplary embodiment of a sheet metal straightener of the invention 001 in a closed state, in which moving anvil 105 has been fully motivated towards stationary anvil 104 of the invention of the invention, is depicted. Threaded compression force adjusting rod 109 may comprise a knurled knob 110. In this manner, a user may adjust the amount of force used to straighten a sheet structure to be straightened 200 that is captured between moving anvil surface F and stationary anvil surface E when the invention is in a closed state by rotating threaded compression force adjusting rod 109 in its threaded engaged with frame 100 so as to translate distal surface G of compression force adjusting rod 109 further into frame 100 (increasing the compressive force on sheet structure to be straightened 200), or rotating threaded compression force adjusting rod 109 in its threaded engaged with frame 100 so as to translate distal surface G of compression force adjusting rod 109 further out of frame 100 (decreasing the compressive force on sheet structure to be straightened 200).

Figure 7:
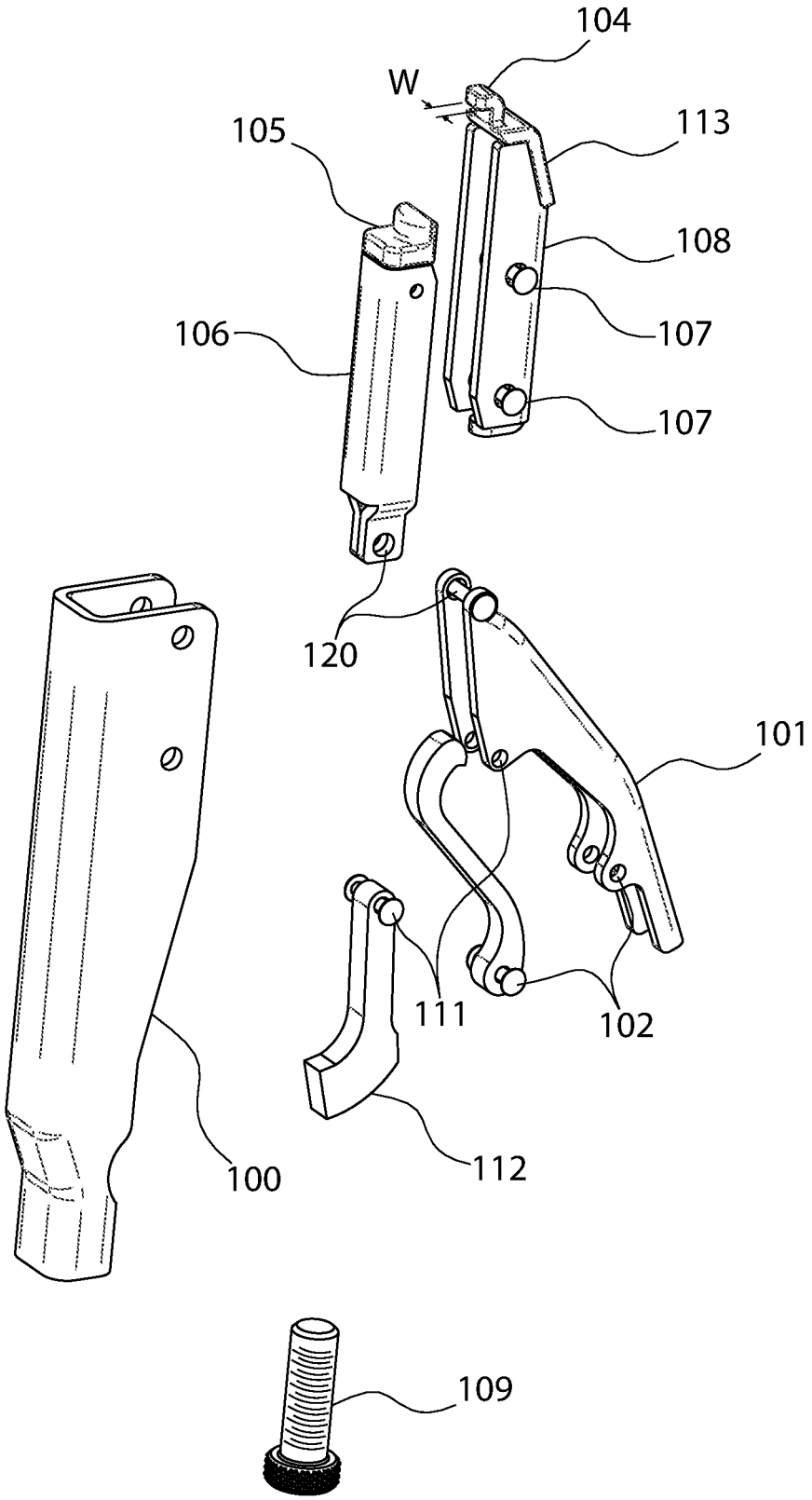
FIG. 7 depicts an exploded view of a non-limiting exemplary embodiment of a sheet metal straightener of the invention.

Referring now to FIG. 7, an exploded view of non-limiting exemplary embodiment of the invention is depicted. Stationary anvil 104, stationary anvil bracket 113, and stationary jaw 108 may be attached to frame 100 at attachment points 107. Moving jaw 106 may be rotably attached to pivot point 120 of handle 101. Handle 101 may be attached to lever 112 at pivot point 111. Threaded compression force adjusting rod 109 may be threadingly engaged with, and protrude into, frame 100.

Figure 8:
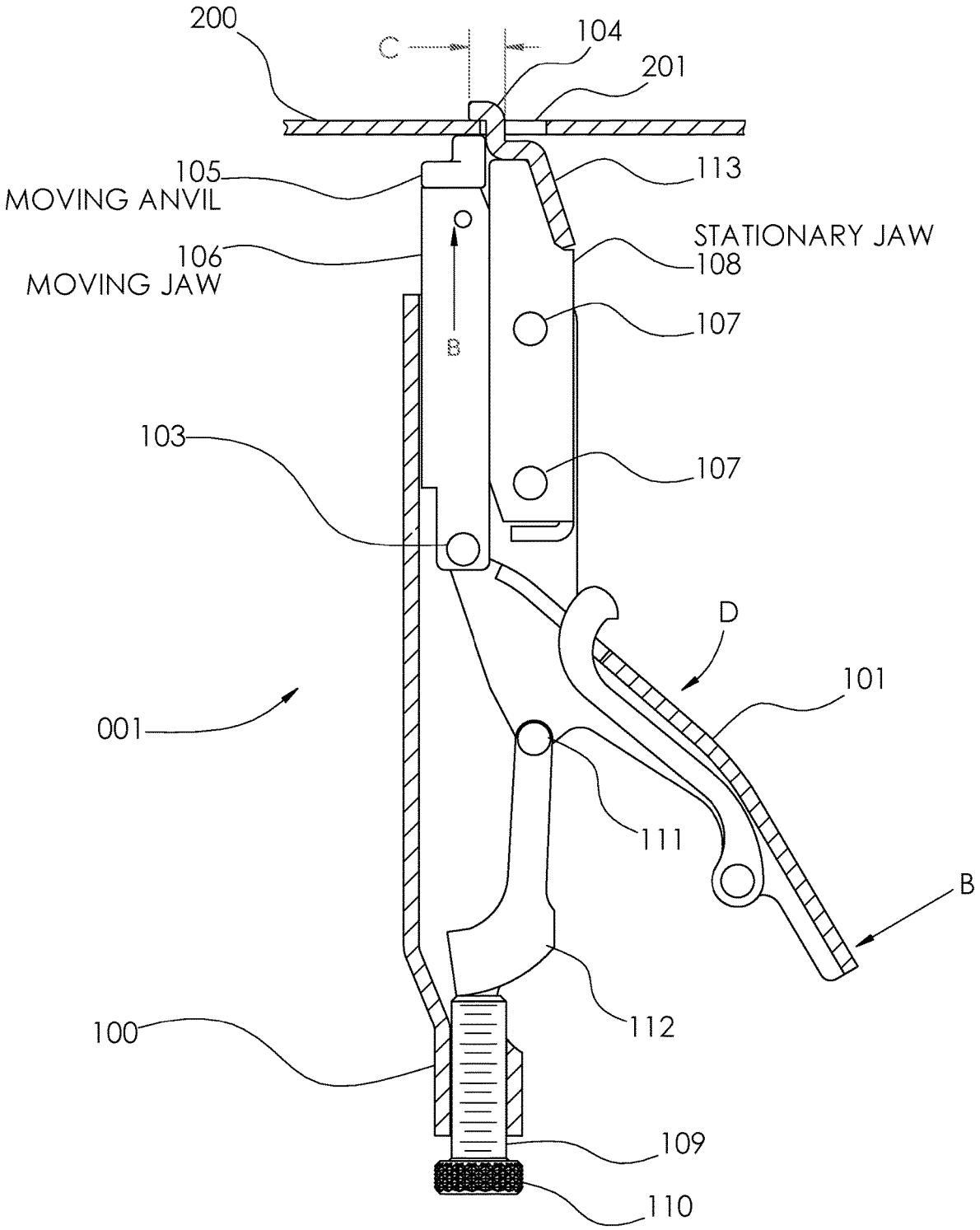
FIG. 8 depicts a side view of a non-limiting exemplary embodiment of a hole straightener of the invention, in which the hole straightener is being used to straighten the deformed edges of a hole in a sheet-metal structure, in which the moving anvil has been motivated towards the stationary anvil, capturing the deformed edges of the hole to be straightened between the moving anvil and the stationary anvil such that continued applied pressure by the moving anvil against the deformed sheet-metal structure, resisted by the stationary anvil, causes the deformed sheet-metal structure to be returned to a substantially non-deformed state.

Referring now to FIG. 8, a side view of a non-limiting exemplary embodiment of a sheet metal straightener of the invention 001, in which hole straightener 001 is being used to straighten the deformed edges of a hole 201 in a sheet-metal structure to be straightened 200, is depicted. Moving anvil 105 has been motivated towards the stationary anvil 104, capturing the deformed edges of deformed sheet metal around hole 201 between moving anvil surface F and stationary anvil E such that continued applied compressive force by the moving anvil against the deformed sheet-metal structure, resisted by the stationary anvil, as handle 101 is motivated towards frame 100 tending to transition hole straightener to a closed state, causes the deformed sheet-metal structure to be returned to a substantially non-deformed state. In this manner the disfigured sheet metal surrounding hole 201 and sheet metal structure 200 is substantially conformed to a desired surface shape. The desired surface shape may be any shape. Although a flat planar surface is depicted in the figures of the drawings, it is within the claimed scope of the invention that the desired surface shape may be any three-dimensional surface shape.

Figure 9:
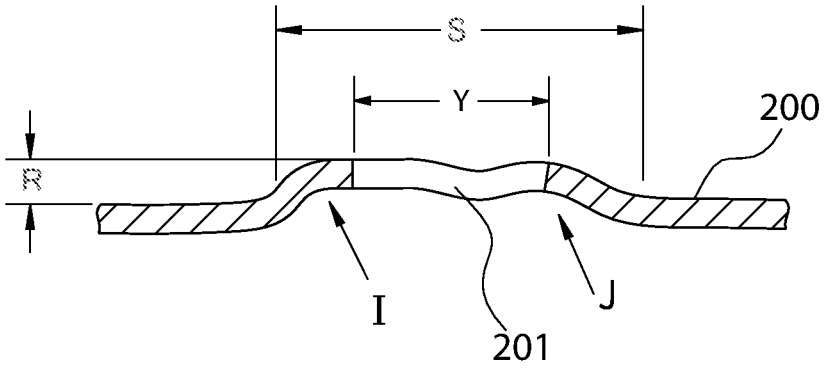
FIG. 9 depicts a cross section view of a sheet-metal structure containing a deformed hole to be straightened.
Figure 10:
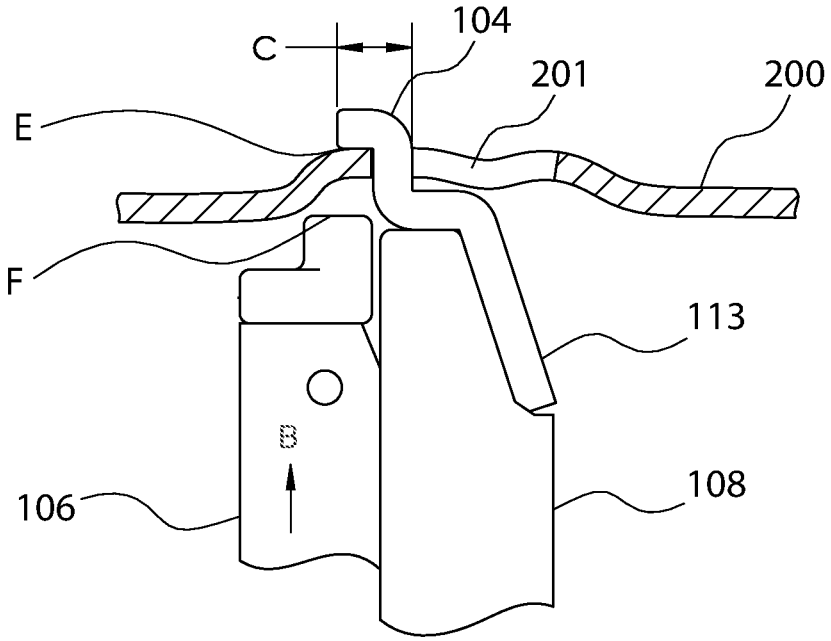
FIG. 10 depicts a cross section view of an embodiment of the sheet metal straightener of the invention in use, in which the stationary anvil is depicted as having been inserted into the hole to be straightened and in which the moving anvil has not yet begun to be motivated against the deformed sheet metal structure, i.e., this view depicts a hole straightener of the invention just prior to the application of straightening forces to the deformed sheet metal structure by the hole straightener.
Figure 11:
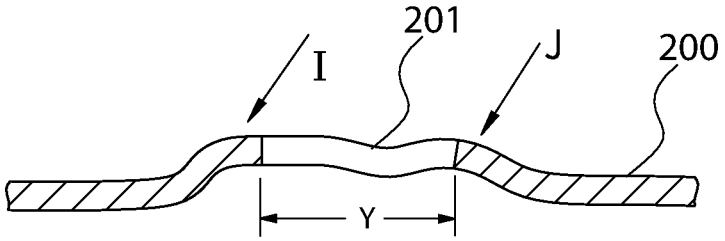
FIG. 11 depicts a cross section view of a deformed sheet-metal structure containing a hole prior to the application of straightening forces by the hole straightening apparatus of the invention.
Figure 12:
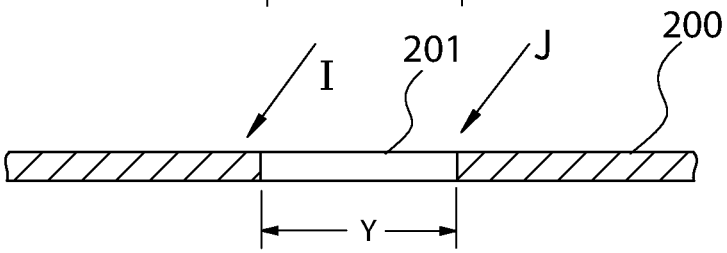
FIG. 12 depicts a cross section view of a repaired sheet-metal structure containing a hole after to the application of straightening forces by the hole straightening apparatus of the invention.

Referring now to FIGS. 9-11, an exemplary deformed sheet metal surface 200 that is be desired to be straightened is depicted. Deformed sheet metal surface 200 may comprise a hole 201 defined by an opening dimension Y. It is not necessary that hole 201 be circular; thus hole 201 may be of any shape. Sheet metal structure 200 may be deformed to a maximum dimension from a desired surface shape by a dimension R in height, and by a dimension S in width. Stationary anvil 104 may be inserted through hole 201 and motivated against a side wall of hole 201 as shown in FIG. 10. In FIG. 10, the hole straightening apparatus of the invention 001 is depicted in an open state. Moving anvil surface F is motivated towards stationary anvil surface E in the direction of arrow B when handle 101 is motivated towards frame 100 as herein discussed in relation to FIGS. 1 through 6. When handle 101 is motivated towards frame 100 the hole straightening apparatus of the invention transitions towards a closed state, causing a compressive force to be applied by moving anvil surface F on the one hand, and stationary anvil surface E on the other hand, capturing a portion of sheet metal structure to be straightened 200 comprising deformity I between the two anvil surfaces E and F. The compressive force causes deformity I to be substantially straightened. In operation, the user then motivates the hole straightening apparatus of the invention 001 around the edge of the opening of hole 201 while sequentially operating handle 101 from an open state to a closed estate, causing a compressive force between anvil surfaces E and F on the sheet metal of structure 200 that surrounds hole 201. Thus, an operator sequentially straightens the deformed sheet metal surrounding hole 201 and sheet metal structure to be straightened 200 by: 1) starting with the hole straightening apparatus of the invention 001 in an open state, inserting anvil 104 through hole 201; 2) motivating anvil 104 towards an edge of hole 201; 3) motivating handle 101 towards frame 100 causing a transition towards a closed state and thereby asserting a compressive force on the sheet-metal structure 200 captured between anvil surfaces E and F as hereinbefore described, 4) transitioning the hole straightening apparatus of the invention 001 into an open state by motivating handle 101 away from frame 100; 5) motivating the sheet metal straightening device of the invention 001 along an edge of hole 201 to a next portion of deformed sheet-metal surrounding the opening of hole 201 and sheet-metal structure 200 to be straightened, and repeating steps 1) through 4). Steps 1) through 5) are then repeated until all of the deformed sheet metal surrounding the edge of the opening of hole 201 have been substantially straightened. FIG. 11 depicts an initial view of a sheet metal structure 200 that has been subjected to disfiguring forces, causing deformities in the sheet metal surrounding hole 201, and for which straightening is desired. FIG. 12 depicts a final view of a sheet metal structure 200 that has been subjected to the above procedure for hole straightening, using the hole straightening apparatus of the invention 001. In FIG. 12, the surface deformities surrounding hole 201 have been substantially removed from sheet metal structure 200 such that sheet-metal structure 200 has been substantially conformed to a desired surface shape.

Any of the described features may be present, in any combination, in any embodiment of the invention.

What is claimed is:

1. A sheet metal straightening apparatus, comprising:

a handle pivotally attached to a frame;

a moving jaw comprising a first anvil surface having a surface area, wherein the moving jaw is slidingly engaged with a surface of the frame;

a stationary jaw comprising a second anvil surface having a surface area wherein the stationary jaw is attached to the frame; and a lever pivotally attached to the frame and pivotally attached to the handle;

wherein when the handle is moved towards the frame, a surface of the lever is in contact with and moves the moving jaw along a surface of the frame towards the stationary jaw;

the sheet metal straightening apparatus having a closed state wherein the first and second anvil surfaces are operable to capture an edge of a hole in a deformed sheet metal structure between them with sufficient compressive force to return the edge of the hole to a desired shape;

the sheet metal straightening apparatus having an open state wherein the first anvil surface of the moving jaw is moved away from the second anvil surface of the stationary jaw, creating an anvil gap between the first anvil surface of the moving jaw and the second anvil surface of the stationary jaw;

wherein the stationary jaw has a width less than a dimension of said hole in said deformed sheet metal structure desired to be straightened, such that the stationary jaw may be inserted through the hole; and wherein said surface area of said first anvil surface is greater than said surface area of said second anvil surface.

2. The sheet metal straightening apparatus of claim 1, further comprising a threaded compression force adjusting rod threadingly engaged with the frame and protruding into the frame, wherein a distal surface of the threaded compression force adjusting rod is in contact with a surface of said lever such that when the threaded compression force adjusting rod is rotated so as to protrude further into the frame, the compressive force is increased when the hole straightening apparatus is in said closed state, and when the distal surface of the threaded compression force adjusting rod is rotated so as to proceed further out of the frame, the compressive force is decreased when the hole straightening apparatus is in said closed state.

3. The sheet metal straightening apparatus of claim 1, wherein the stationary jaw is fabricated from sheet steel.

4. The sheet metal straightening apparatus of claim 3, further comprising a threaded compression force adjusting rod threadingly engaged with the frame and protruding into the frame, wherein a distal surface of the threaded compression force adjusting rod is in contact with a surface of said lever such that when the threaded compression force adjusting rod is rotated so as to protrude further into the frame, the compressive force is increased when the hole straightening apparatus is in said closed state, and when the distal surface of the threaded compression force adjusting rod is rotated so as to proceed further out of the frame, the compressive force is decreased when the hole straightening apparatus is in said closed state.

5. The sheet metal straightening apparatus of claim 1, wherein the moving jaw is fabricated from sheet steel.

6. The sheet metal straightening apparatus of claim 5, further comprising a threaded compression force adjusting rod threadingly engaged with the frame and protruding into the frame, wherein a distal surface of the threaded compression force adjusting rod is in contact with a surface of said lever such that when the threaded compression force adjusting rod is rotated so as to protrude further into the frame, the compressive force is increased when the hole straightening apparatus is in said closed state, and when the distal surface of the threaded compression force adjusting rod is rotated so as to proceed further out of the frame, the compressive force is decreased when the hole straightening apparatus is in said closed state.

7. A sheet metal straightening apparatus, comprising:

a handle pivotally attached to a frame;

a moving jaw comprising a first anvil surface having a surface area, wherein the moving jaw is slidingly engaged with a surface of the frame;

a stationary jaw comprising a second anvil surface having a surface area, wherein the stationary jaw is attached to the frame; and a lever pivotally attached to the frame and pivotally attached to the handle;

wherein when the handle is moved towards the frame, a surface of the lever is in contact with and moves the moving jaw along a surface of the frame towards the stationary jaw;

the sheet metal straightening apparatus having a closed state wherein the first and second anvil surfaces are operable to capture an edge of a hole in a deformed sheet metal structure between them with sufficient compressive force to return the edge of the hole to a desired shape;

the sheet metal straightening apparatus having an open state wherein the first anvil surface of the moving jaw is moved away from the second anvil surface of the stationary jaw, creating an anvil gap between the first anvil surface of the moving jaw and the second anvil surface of the stationary jaw;

the moving jaw has a width less than a dimension of said hole in said deformed sheet metal structure desired to be straightened; and wherein said surface area of said first anvil surface is greater than said surface area of said second anvil surface.

8. The sheet metal straightening apparatus of claim 7, further comprising a threaded compression force adjusting rod threadingly engaged with the frame and protruding into the frame, wherein a distal surface of the threaded compression force adjusting rod is in contact with a surface of said lever such that when the threaded compression force adjusting rod is rotated so as to protrude further into the frame, the compressive force is increased when the hole straightening apparatus is in said closed state, and when the distal surface of the threaded compression force adjusting rod is rotated so as to proceed further out of the frame, the compressive force is decreased when the hole straightening apparatus is in said closed state.

9. The sheet metal straightening apparatus of claim 7, wherein the stationary jaw is fabricated from sheet steel.

10. The sheet metal straightening apparatus of claim 9, further comprising a threaded compression force adjusting rod threadingly engaged with the frame and protruding into the frame, wherein a distal surface of the threaded compression force adjusting rod is in contact with a surface of said lever such that when the threaded compression force adjusting rod is rotated so as to protrude further into the frame, the compressive force is increased when the hole straightening apparatus is in said closed state, and when the distal surface of the threaded compression force adjusting rod is rotated so as to proceed further out of the frame, the compressive force is decreased when the hole straightening apparatus is in said closed state.

11. The sheet metal straightening apparatus of claim 7, wherein the moving jaw is fabricated from sheet steel.

12. The sheet metal straightening apparatus of claim 11, further comprising a threaded compression force adjusting rod threadingly engaged with the frame and protruding into the frame, wherein a distal surface of the threaded compression force adjusting rod is in contact with a surface of said lever such that when the threaded compression force adjusting rod is rotated so as to protrude further into the frame, the compressive force is increased when the hole straightening apparatus is in said closed state, and when the distal surface of the threaded compression force adjusting rod is rotated so as to proceed further out of the frame, the compressive force is decreased when the hole straightening apparatus is in said closed state.

* * * * *